United States Patent [19]

Scott, Jr.

[11] 4,351,116

[45] Sep. 28, 1982

[54] APPARATUS FOR MAKING MULTIPLE ORIENTATION MEASUREMENTS IN A DRILL STRING

[75] Inventor: Floyd L. Scott, Jr., Houston, Tex.

[73] Assignee: BJ-Hughes Inc., Long Beach, Calif.

[21] Appl. No.: 186,922

[22] Filed: Sep. 12, 1980

[51] Int. Cl.[3] ..... E21B 47/022

[52] U.S. Cl. ..... 33/307

[58] Field of Search ..... 33/307, 306, 304, 312, 33/305, 302, 313

[56] References Cited

U.S. PATENT DOCUMENTS

| | | | |
|---|---|---|---|
| 3,274,694 | 9/1966 | Hildebrandt | 33/307 |
| 3,571,936 | 3/1971 | Taylor | 33/306 |
| 4,235,021 | 11/1980 | Claycomb | 33/307 |

*Primary Examiner*—William D. Martin, Jr.

*Attorney, Agent, or Firm*—Robert A. Felsman; Charles D. Gunter, Jr.

[57] ABSTRACT

An apparatus for making orientation measurements in a drill string within a well bore comprising a tubular housing (22) adapted for insertion into the drill string and first (13) and second (15) measuring devices in the housing for measuring first and second orientation characteristics, respectively, of the drill string. A signal generator (23) is responsive to the two measuring devices to provide a signal which is representative of the orientation characteristics measured. The measuring devices are operated alternately so that the signal from the signal generator is alternately representative of the first and second orientation characteristics. The signal from the signal generator, when the latter is controlled by the first measuring device, is different from the signal when the latter is controlled by the second measuring device so that it is readily apparent which of the two measuring devices is reporting.

4 Claims, 5 Drawing Figures

APPARATUS FOR MAKING MULTIPLE ORIENTATION MEASUREMENTS IN A DRILL STRING

TECHNICAL FIELD

The present invention relates to well drilling. More specifically, the invention relates to the determination of the orientation of a well bore relative to vertical and the orientation of the drill tool face with respect to the low side of a well bore when the bore is not vertical.

BACKGROUND

In the drilling of wells, such as oil wells, it is often necessary or desirable to have information concerning the orientation of the drill string. For example, orientation measurements can be made to determine the amount of deviation of the hole from the vertical. Measurements can also be made to determine the direction of the tool face in relation to the low side of the hole. Instruments for making one or the other of the orientation measurements of this type are well known and are commercially available from the assignee of record. In addition, instruments for making one or the other of such orientation measurements are disclosed in the art.

At least some of the orientation measuring tools function satisfactorily. However, in some instances, it is desirable to obtain both such orientation measurements from a well at about the same time. The so-called mud pulse telemetry tools now available are not generally suited for simultaneous employment in the same drill string. For example, signaling of both measurements using the conventional mud-pulsing technique would be difficult or impossible with multiple orientation instruments simultaneously employed in the drill string.

DISCLOSURE OF THE INVENTION

This invention provides an apparatus for making multiple orientation measurements in a drill string. In addition, portions of the currently available orientation measuring instruments are eliminated.

To obtain multiple orientation measurements, two or more measuring devices may be employed within a tubular housing in a drill string. Preferably, each of the measuring devices is capable of measuring a particular orientation characteristic of the drill string. Although various different orientation characteristics may be measured, deviation of the borehole from the vertical and the direction of the tool face in relation to the low side of the borehole are discussed herein as exemplary.

After each measuring device measures its assigned orientation characteristic of the borehole, that information must be signaled to the earth's surface. This is accomplished by utilizing a signal generator which is responsive to the measuring devices to provide a signal representative of the orientation characteristic which have been measured.

With this invention, selection means is provided to cause the signal generator to respond sequentially to the measuring devices so that the orientation measurement from each of the measuring devices is signalled sequentially to the surface. This is vastly superior to superimposing the signals resulting from each measuring device because of the possibility of this resulting in an indecipherable reading. Accordingly, the signal from each measuring device is separate.

Cam means can advantageously be utilized for sequentially operating the measuring devices. In a preferred construction, an actuator rod is mounted for generally axial movement in the housing, and the cam means sequentially couples the measuring devices to the actuator rod. The measuring devices are responsive to being driven by the actuator rod to measure the assigned orientation characteristics. The signal generator is, in turn, adjusted by the measuring devices after the measurements have been made.

One one signal generator is required regardless of how many measuring devices are utilized. The measuring devices are preferably of the mud-pulse telemetry type, and in this event, the signal generator may comprise the currently available pulse ring fitting and signaling knob. Each of the measuring devices adjusts the signaling knob in sequence. Moreover, only a single coding section is required.

The signal from the signal generator indicates which of the measuring devices is reporting. This is accomplished by appropriately coding the signal. For example, if the signal comprises a plurality of pulses, pulse duration can be varied to indicate which of the measuring devices is reporting.

In tools utilizing mud pulse signaling, the housing of the tool is typically filled with an oil. The tool includes a restrictor defining an orifice through which the oil must flow and, in so doing, the rate at which the tool can move the signaling knob is retarded. With this invention, the restrictor is used, and the orifice of the restrictor is bypassed when that tool is not operating. Thus, only the orifice of the tool or measuring device which is activated is utilized to retard movement of the signaling knob. By providing each measuring device with an orifice of a different cross-sectional area, the rate at which the signaling knob is retarded is made different for each measuring device. This, in turn, causes the pulse duration of each of the mud pulses to be different so that the signal contains a characteristic indicating which of the measuring devices is reporting.

The invention, together with further features and advantages thereof, may best be understood by reference to the following description taken in connection with the accompanying illustrative drawings.

DESCRIPTION OF THE PREFERRED EMBODIMENT

Figure 1:
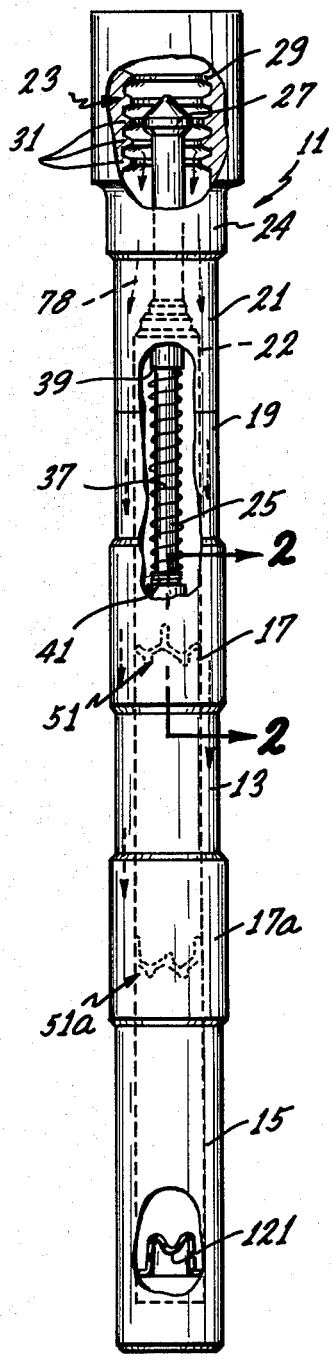
FIG. 1 is an elevational view, with portions broken away, of an apparatus for making multple orientation measurements constructed in accordance with this invention.

FIG. 1 shows an apparatus 11 for making multiple orientation measurements in a drill string. The apparatus 11 is adapted for insertion into a drill string (not shown) for use in drilling a borehole or well. The apparatus 11 generally includes measuring devices 13 and 15, selection mechanisms 17 and 17*a*, a spring housing 19, a coding section 21, and a signal generator 23, all of which are mounted within an inner tubular housing 22 which, in turn, is mounted within an outer housing 24 in a known manner. The interior of the housing 22 is filled with an oil, such as a silicone oil, in accordance with conventional practice.

The measuring device 13 and 15 may be conventional devices of the type adapted to make an orientation measurement of the drill string. For example, the measuring device 13 can be of the type which determines the direction of the tool face of the drill string in relation to the low side of the borehole, and the measuring device 15 can be used to measure the amount the borehole deviates from the vertical. Each of the measuring devices 13 and 15 is a gravitational transducer which responds in a known way to longitudinal movement of an actuator rod 25 in one direction to make its orientation measurement by arresting axial movement of the rod with the location at which the rod is arrested being a function of the measurement. More specifically, the measuring devices 13 and 15 may be tools of the type available from BJ-HUGHES Inc. under the trademarks TELEORIENTER and TELEDRIFT, respectively, modified as shown and described herein.

The coding section 21 and the signal generator 23 may also be conventional and may be, for example, of the type employed in the TELEDRIFT and TELEORIENTER instruments, of the type shown in Taylor U.S. Pat. No. 3,571,936, or of the type shown in copending U.S. application Ser. No. 844,398, filed Oct. 21, 1977, entitled "Wide Angle Inclinometer." However, with this invention, a single coding section 21 and single generator 23 are utilized by the two measuring devices 13 and 15 whereas, with the prior art constructions, each measuring device required a separate coding section and separate signal generator.

The actuator rod 25 is drivingly coupled at one end to a signaling knob 27 by the coding section 21, and the signaling knob is adapted to pass through a pulse ring fitting 29 comprising a plurality of annular rings 31. As is conventional and, as explained more fully hereinbelow, the location of the signaling knob 27 axially within the pulse ring fitting 29 is utilized to provide a signal representative of the measured orientation characteristic. The coding section 21 is of conventional construction and is used in a conventional manner to position the signaling knob 27 as a function of the axial position of the actuator rod. For example, if the coding section of Taylor U.S. Pat. No. 3,571,936 were to be utilized with this invention, the actuator rod 25 could be coupled to the connector 73 of Taylor, and when so coupled, the signaling knob 27 would be allowed to move upwardly a distance inversely related to the upward travel of the actuator rod 25. Thus, in this example, the driving connection between the actuator rod 25 and the signaling knob 27 provides an inverse relationship between the upward distances traveled by the actuator rod 25 and the signaling knob 27.

Generally, the selection mechanisms 17 and 17*a* select which of the measuring devices 13 and 15 will be active, i.e., operable to make an orientation measurement and then position the signaling knob 27 within the pulse ring fitting 29. The selection mechanisms 17 and 17*a* may be identical, except as expressly noted herein. The selection mechanisms 17 and 17*a* also are operative to cause the signal generator 23 to provide different signals for each of the mesuring devices 13 and 15 so that the measuring device which is reporting will be readily ascertainable from the signal.

Figure 2:
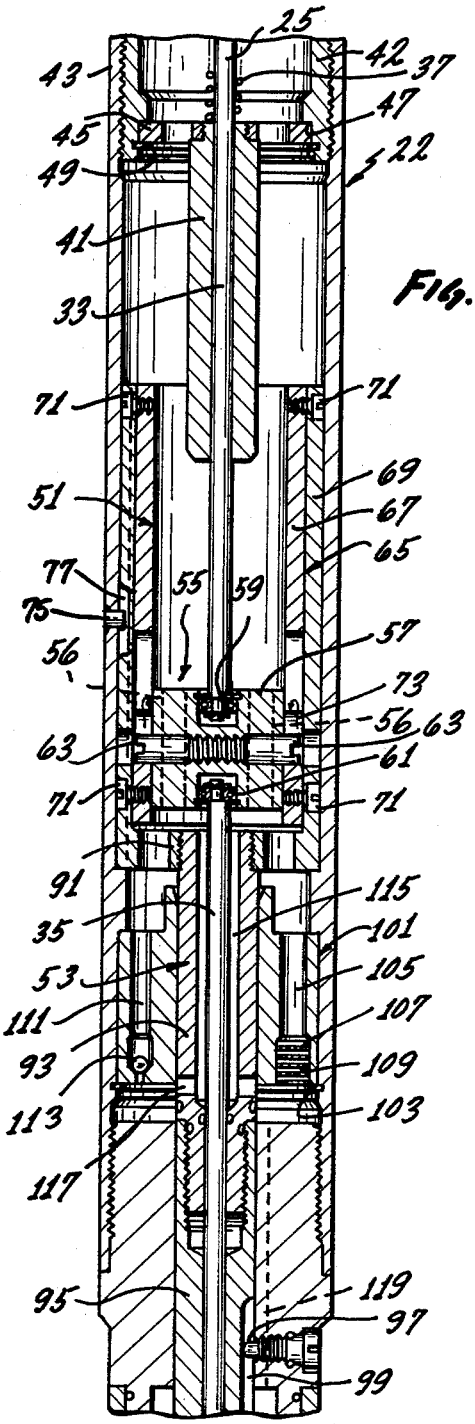
FIG. 2 is an enlarged fragmentary sectional view taken generally along line 2—2 of FIG. 1 illustrating one of the cams at its lowermost position.
Figure 3:
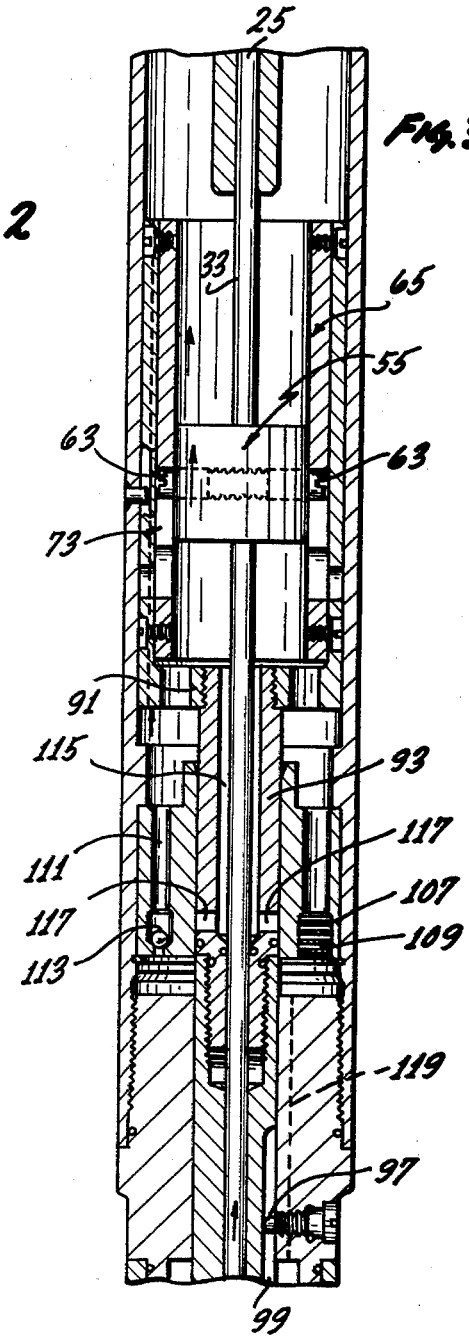
FIG. 3 is an enlarged fragmentary sectional view, similar to FIG. 2, with the cam at its uppermost position.

Turning now to the details of the specific preferred embodiment, the actuator rod 25 may include actuator rod sections 33 and 35 (FIG. 2). A pendulum lift spring 37 may bear against a shoulder 39 (FIG. 1) of the actuator rod section 33 and a bushing 41 to urge the actuator rod 25 upwardly as viewed in FIGS. 1–3. The housing 22 preferably includes a spring housing section 42 attached by screw threads to a selector housing section 43 (FIG. 2).

Bushing 41 may be threaded into an apertured mounting plate 45 held between a shoulder 47 and a retaining ring 49. The bushing 41 thus will project axially into the selector housing section 43 and support the actuator rod section 33 for axial sliding movement.

When it is desired to have the measuring device 13 make an orientation measurement, the pendulum lift spring 37 is allowed to move the actuator rod section 33 up as explained more fully hereinbelow. A cam 51 may selectively be employed to the axial movement of the actuator rod section 33 to be transmitted to a tubular shaft 53. The tubular shaft 53 provides an input motion to the measuring device 13 to which the measuring device responds and provides an orientation measurement in a known manner. For example, if the measuring device 13 is a drift instrument of the type which employs a pendulum as the gravity responsive means, the lower end of the tubular shaft 53 can be coupled directly to the pendulum. Alternatively and by way of an additional example, if the measuring device 13 is a drift instrument of the type disclosed in Taylor U.S. Pat. No. 3,571,936, the tubular shaft 53 of this invention can be coupled into the Taylor instrument in essentially the same manner as the coding rod 60 of Taylor. If the measuring device 13 is of the type which determines the direction of the tool face of the drill string in relation to the low side of the borehole, a stepped rotatable counterweight is used in lieu of the pendulum, and the tubular shaft 53 can be coupled to drive the gravity responsive means in essentially the same way. In any event, the actuator rod 25 must project through the measuring device 13 in order to operate the selection mechanism 17*a*.

The cam 51 may include a driving member 55 having axial passages 56 extending therethrough. The driving member 55 may include a collar 57 rotatably mounted by bearings 59 and 61 to the confronting ends of the actuator rod sections 33 and 35 and two radial pins 63 which extend in opposite directions through the collar. The cam 51 may also include a follower sleeve 65 which, in the embodiment illustrated, includes an inner sleeve 67 and an outer sleeve 69 held together by screws 71. As shown, the inner sleeve 67 has a cam slot 73 for receiving the pins 63. The follower sleeve 65 may be mounted in the selector housing section 43 for axial movement by means of a key 75 extending into an axially extending keyway 77 formed in the outer surface of the outer sleeve 69. Accordingly, axial movement of the actuator rod section 33 will cause rotation of the collar 57 and axial movement of the follower sleeve 65 as the pins 63 are moved by the collar along the configuration of the cam slot 73.

While drilling, fluid commonly known as drilling mud is continuously pumped down the drill string through the pulse ring fitting 29 and a bypass passages 78 (FIG. 1) between the housings 22 and 24 to the drill bit (not shown) located below the measuring device 15.

The bypass passage 78 preferably lies outside the housing 22 so that the working parts of the apparatus 11 do not come into contact with the drilling mud. The pressure of the drilling mud acting on the signaling knob 27 forces the signaling knob and the system structure below it to its lowermost position (FIG. 2) against the biasing action of the spring 37. Accordingly, with the drilling mud passing through the instrument during drilling, the cam 51 and the actuator rod 25 are in the lowermost position shown in FIG. 2.

To make an orientation measurement, the bit is picked up off the bottom of the bore a short distance and drilling mud circulation is stopped. This allows the spring 37 to urge the actuator rod 25 upwardly to adjust the coding section 21 which in turn allows upward movement of the signaling knob 27 within the pulse ring fitting 29. Upward movement of the signaling knob 27 continues until it is arrested by the active one of the measuring devices 13 or 15 acting through the coding section 21. In this manner, operation of the apparatus 11 involves reciprocation of the actuator rod section 33.

A primary function of the cam 51 is to drivingly couple the actuator rod section 33 to the tubular shaft 53 on every even-numbered cycle of reciprocation. The selection mechanism 17*a* may have a similar cam 51*a* (FIGS. 1 and 4) to couple the actuator rod 25 to the measuring device 15 on every odd-numbered cycle of reciprocation. In this manner, the measuring devices 13 and 15 are caused to operate alternately. Of course, if three of the measuring devices were provided, then three cams would be necessary with each of the cams operating its associated measuring device on every third cycle of reciprocation.

Figure 4:
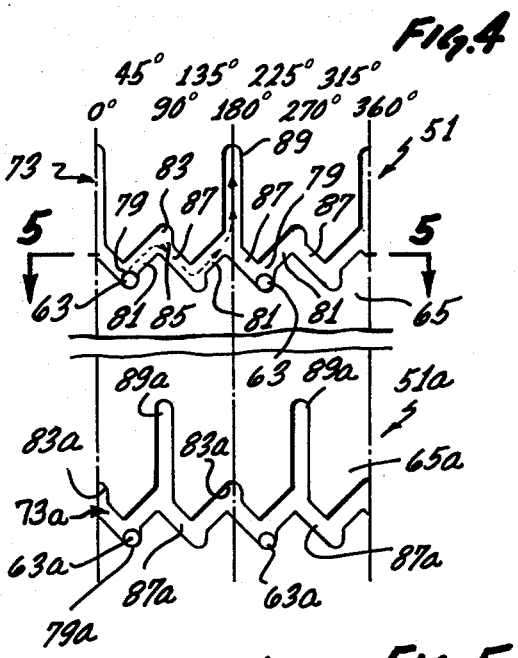
FIG. 4 is a cam layout of the two cams used for sequencing the apparatus.
Figure 5:
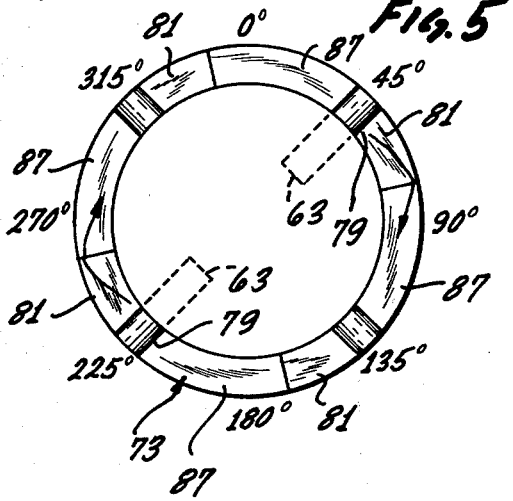
FIG. 5 is a sectional view, taken generally along line 5—5 of FIG. 4, showing how the cam layout is applied to a cam sleeve.

One cam layout which would bring about alternate operation of the measuring devices 13 and 15 is shown by way of example in FIG. 4. Portions of the cam 51*a* corresponding to portions of the cam 51 are identical to the cam 51, except that the cam slots 73 and 73*a* are out of phase with each other.

With the actuator rod 25 in its lowermost position, as shown in FIG. 2, the pins 63 and 63*a* of the two cams are in the start, or the 45° and 225° positions, as shown in FIG. 4. The cam slot 73 may include an axially extending bypass closure leg 79 and an axially and circumferentially extending leg 81 which terminates in a lifting section 83 at the 90° position. The lifting section 83 preferably opens into an axial leg 85 and, from there, to an axial and circumferentially extending leg 87. The portion of the cam slot 73 thus described then repeats, except that the next leg 81 opens into a passive section 89 which is much longer than the lifting section 83. The cam slot 73*a* may be identical to slot 73 except that, if two measuring devices are used, the two slots should be 90° out of phase, as shown. In the embodiment illustrated, there is a passive section 89 in slot 73 at 0° and 180° and there is a passive section 89*a* in slot 73*a* at 90° and 270° about the common axis of the cams.

When the pendulum lift spring 37 moves the actuator rod 25 upwardly, the pins 63 move through the legs 79 and 81 and into the lifting sections 83 at the 90° and 270° positions. So long as the pins 63 move in sections of the cam slot 73 having vertically extending components, no axial movement will be imparted to the follower sleeve 65 and the collar will be rotated by movement of the pins within those portions of the slots having horizontal components. However, axial movement of the actuator rod 25, after the pins 63 reach the end of their lifting sections 83, will result in upward movement of the follower sleeve 65.

Pins 63*a* enter passive sections 89*a* when the pins 63 are in the lifting sections 83, and consequently, the follower sleeve 65*a* is not moved axially or rotationally during this time.

When the actuator rod 25 is again moved downwardly by the pressure of the drilling mud on knob 27, the pins 63 will move the follower sleeve 65 to the lowermost position of FIG. 2. At the same time, the pins 63*a* will move out of the passive slots 89*a* and through the legs 87*a* to the 135° and 315° positions shown in FIG. 4.

Upon the next cycle of reciprocation, the operation described above is repeated, except that the pins 63 will move into the passive sections 89 so that the follower sleeve 65 is not moved axially: the pins 63*a* will move into the lifting sections 83*a* at the 0° and 180° positions to lift the follower sleeve 65*a* and operate the measuring device 15. Thus, both of the cam slots 73 and 73*a* have active and passive cam surface sections for driving and non-driving, respectively, the associated measuring devices 13 and 15. Also, the cams 51 and 51*a* may be arranged with the active and passive surfaces of the cam 51 being out of phase with the active and passive surfaces of the cam 51*a* to bring about the alternate operation of the measuring devices 13 and 15. In the embodiment illustrated, the pins 63 and 63*a* move circumferentially through 45 degrees on each stroke of the actuator rod 25. In other words, as the rod 25 moves downwardly, the collars 57 and 57*a* (not shown) rotate 45° to move the pins 63 and 63*a* against the bypass closure legs 79 and 79*a*.

Although the motion of the cams can be transmitted to their respective measuring devices 13 and 15 in various ways, with reference to cam 51 in the embodiment illustrated, the outer sleeve 69 is shown to have an end wall 91 (FIGS. 2 and 3), and the tubular shaft 53 is threaded into a central opening in the end wall. In the embodiment illustrated, the tubular shaft 53 includes two tubular shaft sections 93 and 95 which are appropriately threaded together, with the tubular shaft section 95 being mounted for axial sliding movement by a key 97 and a keyway 99. The cam 51*a* may be identically coupled to the measuring device 15.

The active one of the measuring devices 13 and 15 terminates upward movement of the actuator rod 25 in a known manner in accordance with the orientation measurement being made. Thus, the axial position of the actuator rod 25, when upward movement is halted (FIG. 3), corresponds to the orientation measurement made by the active measuring device. The coding section 21 positions the signaling knob 27 within the pulse ring fitting 29 in accordance with the axial position of the actuator rod 25. In this manner, the active one of the measuring devices 13 and 15 adjusts the signal generator 23.

Thereafter, mud is forced down through the apparatus 11 as described above to return the components of the apparatus to the position shown in FIG. 2. As the mud passes between the restrictions afforded by bringing the signaling knob 27 into close proximity to one of the rings 31, a mud pulse is generated in a known manner.

In order to assure that the signaling knob 27 moves downwardly past each ring 31 slowly enough to generate a pulse, it is conventional practice to utilize a fluid operated mechanism to retard movement of the signaling knob. This fluid operated mechanism typically includes orifices through which fluid must pass in order to permit movement of the actuator rod 25 downwardly.

The present invention utilizes fluid operated means for this purpose but sequentially operates the fluid operated means so that only the fluid operated means of the active measuring device is operative. The fluid operated means of the inactive measuring device is caused to be inactive. The provision of a different size orifice in each of the fluid operated means causes the rate of movement of the signaling knob 27 to be different for the two measuring devices. Consequently, the duration of the pulses for each of the measuring devices is also different. In this manner, pulse duration is used to indicate which of the two measuring devices is reporting.

To accomplish this, the apparatus 11 may include a tubular restrictor 101 rigidly mounted in the selector housing section 43 by a retaining ring 103. The restrictor 101 in this embodiment, has an axially extending passage 105 in which a plurality of discs 107, having orifices 109, are retained. Such a restrictor is produced by The Lee Company under the name, "Visco Jet." The restrictor 101 may also have an axial passage 111 in which a check valve 113 is mounted. The check valve 113 permits upward fluid flow and blocks downward flow through the passage 111. In addition, a relief valve (not shown) may also be mounted in the restrictor 101. The relief valve can be set to open at a preset pressure to prevent overpressuring of the housing. The restrictor 101, the relief valve (not shown), the discs 107, and the check valve 113 may be of conventional construction.

The tubular shaft section 93 may be spaced radially from the section 35 of actuator rod 25 as shown to partially define an annular bypass passage 115. The passage 115 opens into radial ports 117 in the tubular shaft section 93. The tubular shaft section 93 is movable axially with the follower sleeve 65 due to the threaded connection at end wall 91 and, by moving the tubular shaft section 93 upwardly as viewed in FIG. 3, The ports 117 may thus be closed off by the inner periphery of the restrictor 101, thereby closing the bypass passage 115. Thus, the tubular shaft section 93 may serve as a valve sleeve.

At its upper end, the bypass passage 115 may be formed so as to communicate with the interior of the follower sleeve 65 via passages 56 and with the interior of the upper regions of the housing 22. At its lower end, the bypass passage 115 may communicate with an axial passage 119 which may extend through the apparatus 11 to the upper side of a diaphragm 121 (FIG. 1) located at the bottom of the housing 22. The diaphragm 121 may be of the type which is conventionally used in instruments of this kind to accommodate volume changes within the housing 22 due to the variations of the volume as the rod 25 is moved into and out of the housing 22. Thus, the diaphragm 121 flexes downwardly when the rod 25 moves downwardly and moves upwardly when the rod 25 moves upwardly.

Thus, there may be communication between the upper end of the housing 22 at the location thereof through which the rod 25 projects and the upper face of the diaphragm 121. At the restrictor 101, this communication may be provided by the check valve 113, the bypass passage 115, and the orifices 109, depending upon which of the measuring devices 13 and 15 is operating and further depending upon the axial position of the actuator rod 25.

For example, the first increment of upward movement of the pins 63 in the lifting slots 83 raises the follower sleeve 65 and the tubular shaft section 93 to move the ports 117 completely into the restrictor 101 to close off the ports 117. During this initial increment of movement, the coding section does not allow the signaling knob 27 to move upwardly. Further upward movement of the actuator rod 25 and the pins 63 lifts the follower sleeve 65 toward the position shown in FIG. 3, and this causes the coding section 21 to drive the signaling knob 27 upwardly out of the housing 22, thereby tending to increase the volume within the housing due to the extension of a length of the rod connected to the signaling knob 27 out of the housing. Consequently, the diaphragm 121 is drawn upwardly and the silicone oil is forced upwardly through the passage 119, the check valve 113, and the passage 111 to the upper regions of the housing 22.

On the downward movement of the signaling knob 27, the volume of the housing 22 tends to decrease. As the knob is driven downwardly, the diaphragm 121 will expand downwardly as silicone oil is forced through the orifice 119. This forces the silicone oil through the orifices 109 of the discs 107 because the bypass passage 115 is closed and the check valve 113 will not permit fluid flow downwardly through it. Accordingly, the rate at which the signaling knob 27 can be retracted into the housing 22 is a function of the velocity with which the silicone oil flows through the orifices 109.

It has now been determined that the flow rate through the restrictor may be infinitely determined within a desired range by (a) varying the aperture diameter of the discs, (b) varying the number of discs, or (c) varying both the number of discs and the aperture sizes.

The selector mechanism **17*a* includes a restrictor (not shown) which may be identical to the restrictor 101, except that the orifices thereof are of a diameter different from the orifices 109. Accordingly, when the restrictor of the selector mechanism 17*a* is operative, the retraction or downward movement of the signaling knob 27 is forced to progress at a different velocity than when the restrictor of the selector mechanism 17 is operative. When the restrictor of the selector mechanism 17*a* is operative due to actuation thereof by the cam 51*a*, the bypass passage 115 and the ports 117 in mechanism 17 are open so that the silicone oil need not flow through the orifices 109. In this manner, the orifices 109 are effectively taken out of the fluid flow circuit by the relatively larger cross-sectional area bypass passage 115. Conversely, when the cam 51 is operative to actuate the measuring device 13, the resistor of the selector mechanism 17*a*** provides for the bypass of fluid around its restricted orifices in the same manner.

It can be seen, therefore, that the restrictors of the selector mechanisms 17 and **17*a* operate alternately so that only one operates at any one time. Moreover, the restrictors for the selector mechanisms 17 and 17*a* are operated in sequence by the cams 51 and 51*a***.

Although an exemplary embodiment of the invention has been shown and described, many changes, modifications and substitutions may be made by one having ordinary skill in the art without necessarily departing from the spirit and scope of this invention.

I claim:

1. An apparatus for making orientation measurements in a drill string comprising:

a tubular housing adapted for insertion into the drill string;

an actuator rod mounted for generally axial movement in the housing;

first and second measuring devices in the housing;

first and second cams in the housing for coupling the actuator rod sequentially to the first and second measuring devices, resepctively, whereby components of the first and second measuring devices can be driven by the actuator rod;

the first measuring device including means responsive to being driven by the actuator rod for measuring a first orientation characteristic of the drill string;

the second measuring device including means responsive to being driven by the actuator rod for measuring a second orientation characteristic of the drill string;

signal generating means comprising means for generating a plurality of pulses responsive to the first and second measuring devices for generating a signal representative of the first and second orientation characteristics;

selection means in the housing for causing the signal generating means to respond sequentially to the first and second measuring means whereby the signal is sequentially representative of the first and second orientation characteristics; and signal identification means for causing the signal from the signal generating means when the latter is responsive to the first measuring means to be different from the signal from the signal generating means when the latter is responding to the second measuring means whereby the signal indicates which of the first and second orientation characteristics is represented by the signal.

2. An apparatus as defined in claim 1 wherein the actuator rod is reciprocal in the housing and the first cam couples the actuator rod to the first measuring device on every even-numbered cycle of reciprocation and the second cam couples the actuator rod to the second measuring device on every odd-numbered cycle of reciprocation whereby the measuring devices are alternately operated.

3. An apparatus as defined in claim 1 wherein each of the cams has active and passive cam surfaces for driving and non-driving, respectively, the associated measuring device, the first and second cams being arranged with the active and passive surfaces of the first cam being out of phase with the active and passive surfaces of the second cam whereby the cams sequentially couple the actuator rod to the measuring devices.

4. An apparatus as defined in claim 3 wherein the first cam includes a follower sleeve, means for mounting the follower sleeve in the housing for movement along a path, and a driving member driven by the actuator rod and engageable with the follower sleeve to drive the follower sleeve.

* * * * *